US012806675B2

(12) United States Patent
Tamura et al.

(10) Patent No.: US 12,806,675 B2
(45) Date of Patent: Nov. 24, 2026

(54) HOLLOW SHELL PART MANUFACTURING METHOD

(71) Applicant: NIPPON STEEL CORPORATION, Tokyo (JP)

(72) Inventors: Shohei Tamura, Tokyo (JP); Minoru Kanemaru, Tokyo (JP); Rikuo Kitayama, Tokyo (JP); Akira Shirai, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 228 days.

(21) Appl. No.: 18/715,661

(22) PCT Filed: Dec. 28, 2022

(86) PCT No.: PCT/JP2022/048587
§ 371 (c)(1),
(2) Date: May 31, 2024

(87) PCT Pub. No.: WO2023/136172
PCT Pub. Date: Jul. 20, 2023

(65) Prior Publication Data

US 2025/0033105 A1 Jan. 30, 2025

(30) Foreign Application Priority Data

Jan. 13, 2022 (JP) ..... 2022-003790

(51) Int. Cl.
*B21D 9/08* (2006.01)
*B21D 9/12* (2006.01)

(52) U.S. Cl.
CPC *B21D 9/08* (2013.01); *B21D 9/12* (2013.01)

(58) Field of Classification Search
CPC ... B21D 9/15; B21D 9/12; B21D 7/06; B21D 7/022; B21D 22/025
See application file for complete search history.

(56) References Cited

U.S. PATENT DOCUMENTS

2023/0182191 A1 6/2023 Tamura

FOREIGN PATENT DOCUMENTS

JP S5054565 A * 5/1975 ..... B21D 7/022
JP 53-2422 B 1/1978
(Continued)

OTHER PUBLICATIONS

Translation of JPS5054565.*
Translation of JPS5410265.*

*Primary Examiner* — Bobby Yeonjin Kim
(74) *Attorney, Agent, or Firm* — Birch, Stewart, Kolasch & Birch, LLP

(57) ABSTRACT

A method is disclosed for forming a curved portion with a small curvature radius in an original tube while suppressing wrinkles and buckling. The method includes placing the original tube between a first die and a second die, and pressing one or more times on the original tube by bringing the first die and the second die closer together and pressing the first die and second die against the original tube, wherein the original tube has a circular cross-sectional shape in at least a portion thereof, the first die has a first curved surface, the second die has a second curved surface, in one of the pressing, cross-sectioning and bending are simultaneously performed on at least the portion of the original tube by pressing the first die and second die against at least the portion of the original tube; in the cross-sectioning, the circular cross-sectional shape of the original tube is reduced in diameter, and a diameter reduction rate in one time of the pressing is more than 0% and less than 10%.

9 Claims, 8 Drawing Sheets

(56) References Cited

FOREIGN PATENT DOCUMENTS

| | | | | | |
|---|---|---|---|---|---|
| JP | S5410265 | A | * | 1/1979 | ..... B21D 7/06 |
| JP | 2006-315077 | A | | 11/2006 | |
| JP | 2009-255165 | A | | 11/2009 | |
| JP | 6519984 | B2 | | 5/2019 | |
| WO | WO 2022/014262 | A1 | | 1/2022 | |

* cited by examiner

HOLLOW SHELL PART MANUFACTURING METHOD

FIELD

The present application discloses a manufacturing method for a hollow shell part.

BACKGROUND

PTL 1 discloses a technique for bending and cross-sectioning (processing that transforms the shape of the cross-section which intersects the longitudinal direction of the tube) a straight tube using a press die. In the technique disclosed in PTL 1, high shape accuracy is ensured for a hollow shell part after processing by simultaneously performing cross-sectioning and bending on a straight tube. According to the technique disclosed in PTL 1, a hollow shell part can be obtained only by pressing from the outside of a tube without requiring complicated processes such as hydroforming, thereby improving the productivity of the hollow shell part.

PTL 2 discloses a technique for bending an original tube using a pressing die that can rotationally move. PTL 3 discloses a technique for performing a rotary draw bending processing on an original tube. According to the techniques disclosed in PTL 2 and 3, high shape accuracy is thought to be ensured in the hollow shell part after processing, similarly to the technique disclosed in PTL 1.

CITATION LIST

Patent Literature

[PTL 1] Japanese Patent Publication No. 6519984

[PTL 2] Japanese Unexamined Patent Publication No. 2009-255165

[PTL 3] Japanese Unexamined Patent Publication No. 2006-315077

SUMMARY

Technical Problem

When obtaining a hollow shell part having a curved portion by performing bending on an original tube, unsatisfactory forming such as wrinkles and buckling are easily generated on the surface of the curved portion especially when the curvature radius of the curved portion is small. According to the new finding of the present inventor, this problem may not be avoided even when cross-sectioning and bending are performed simultaneously on an original tube as disclosed in PTL 1.

On the other hand, the bending using a rotatable die as disclosed in PTL 2 and the rotary draw bending processing as disclosed in PTL 3 are considered to be capable of bending an original tube while suppressing unsatisfactory forming such as wrinkles and buckling. However, such techniques require a complicated mechanism to rotate or turn the die and original tube, which harms the productivity of the hollow shell part.

As described above, there is a need for anew method that can easily form a curved portion with a small curvature radius while suppressing wrinkles and buckling of an original tube.

Solution to Problem

As means for solving the above problem, the present application discloses the following aspects:

<Aspect 1>

A manufacturing method for a hollow shell part, the method including:

placing an original tube between a first die and a second die; and moving the first die and the second die relatively closer together and pressing one or more times on the original tube by pressing the first die and the second die against the original tube, wherein the original tube has a circular cross-sectional shape in at least a portion thereof, the first die has a first curved surface, the second die has a second curved surface, in one time of the pressing, the first curved surface and the second curved surface are pressed against at least the portion of the original tube so that cross-sectioning and bending are simultaneously performed on at least the portion of the original tube, in the cross-sectioning, the circular cross-sectional shape of the original tube is reduced in diameter, and a diameter reduction rate in one time of the pressing is more than 0% and less than 10%.

<Aspect 2>

The manufacturing method according to aspect 1, wherein the pressing is performed two or more times, and the diameter reduction rate in each of the pressing is greater than 0% and less than 10%.

<Aspect 3>

The manufacturing method according to aspect 1 or 2, wherein the first die and the second die are linearly brought closer together, so that the first curved surface and the second curved surface are pressed against the original tube.

<Aspect 4>

The manufacturing method according to any one of aspects 1 to 3, wherein in a portion on which the cross-sectioning and the bending are performed, a die opening shape defined by the first die and the second die when the first die and the second die are brought together is smaller than the cross-sectional shape of the original tube and similar to the cross-sectional shape of the original tube.

<Aspect 5>

The manufacturing method according to any one of aspects 1 to 4, wherein the diameter reduction rate in one time of the pressing is more than 0% and 6% or less.

<Aspect 6>

The manufacturing method according to any one of aspects 1 to 5, wherein the original tube is a bent tube having a curved portion, in the bending, a curvature radius of the curved portion is reduced, and in the cross-sectioning, the cross-sectional shape of the curved portion is reduced in diameter.

<Aspect 7>

The manufacturing method according to any one of aspects 1 to 5, wherein the original tube is a straight tube, in the bending, a curved portion is formed in at least a portion of the straight tube, and in the cross-sectioning, the cross-sectional shape of the curved portion is reduced in diameter.

<Aspect 8>

The manufacturing method according to any one of aspects 1 to 7, wherein the first die is an upper die, the second die is a lower die, and in the cross-sectioning and the bending, at least one of the first die and the second die moves in an up-down direction.

<Aspect 9>

The manufacturing method according to any one of aspects 1 to 8, wherein when a period from time when the first die and the second die contact the original tube until when the pressing is completed is halved into a first half and a second half in one time of the pressing, the cross-sectioning and the bending are simultaneously performed on at least a portion of the original tube at least at one point in the second half.

Advantageous Effects

In the manufacturing method of the present disclosure, cross-sectioning as well as bending is performed on at least a portion of an original tube. Since bending and cross-sectioning are performed simultaneously, and in the cross-sectioning, the cross-sectional shape of the original tube is reduced in diameter, unsatisfactory forming (wrinkles and buckling) in the curved portion is suppressed even when obtaining a curved portion with a small curvature radius by the bending. In addition, the manufacturing method of the present disclosure does not require a complicated mechanism for rotating or turning the die and/or the like.

DESCRIPTION OF EMBODIMENTS

The following describes embodiments of a manufacturing method for a hollow shell part according to the present disclosure without limiting the method of the present disclosure to the following embodiments.

Figure 4:
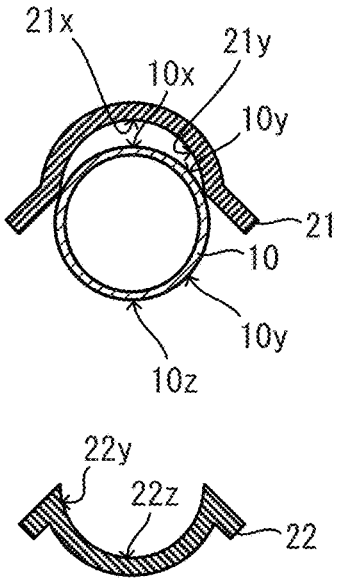
FIG. 4 schematically illustrates the shape of a cross section taken along the like IV-IV of FIG. 3.
Figure 5:
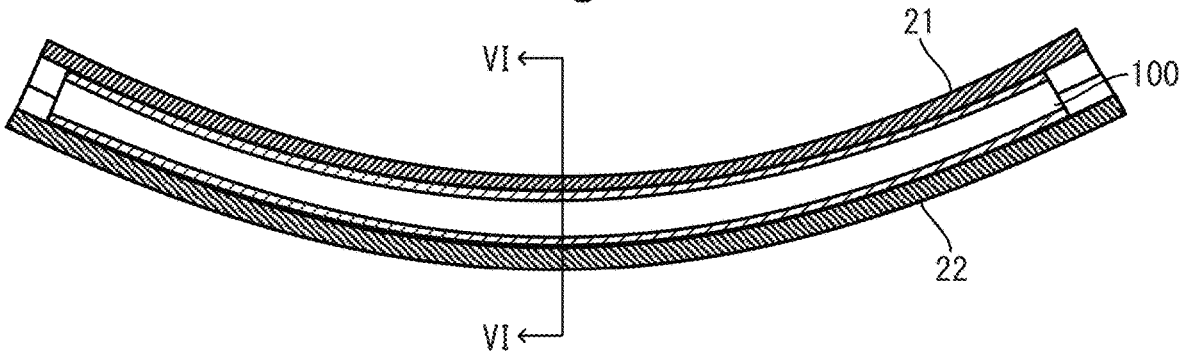
FIG. 5 schematically illustrates the shapes of the cross sections, along the longitudinal direction of the tube, of a hollow shell part 100, the first die 21, and the second die 22 in a state where the first die 21 and the second die 22 are closed and pressing is completed.
Figure 6:
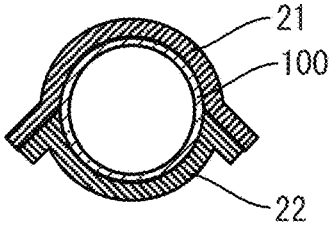
FIG. 6 schematically illustrates the shape of a cross section taken along the line VI-VI of FIG. 5.

As illustrated in FIGS. 1 to 8, the manufacturing method for a hollow shell part 100 according to an embodiment includes:

placing an original tube (a starting material tube) 10 between a first die 21 and a second die 22 (refer to FIGS. 3 and 4); and moving the first die 21 and the second die 22 relatively closer together and pressing one or more times on the original tube 10 by pressing the first die 21 and the second die 22 against the original tube 10 (see FIGS. 5 and 6).

Figure 1:
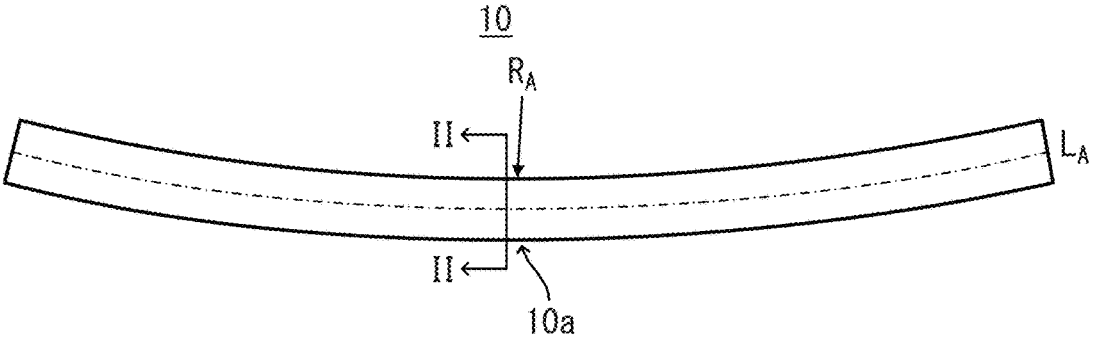
FIG. 1 is a schematic diagram to describe an example of the longitudinal shape of an original tube 10.
Figure 2:
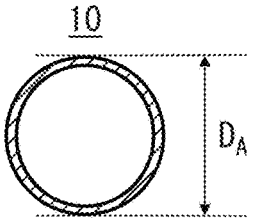
FIG. 2 schematically illustrates the shape of a cross section taken along the line II-II of FIG. 1.

As illustrated in FIGS. 1 and 2, the original tube 10 has a circular cross-sectional shape in at least a portion thereof.

Figure 3:
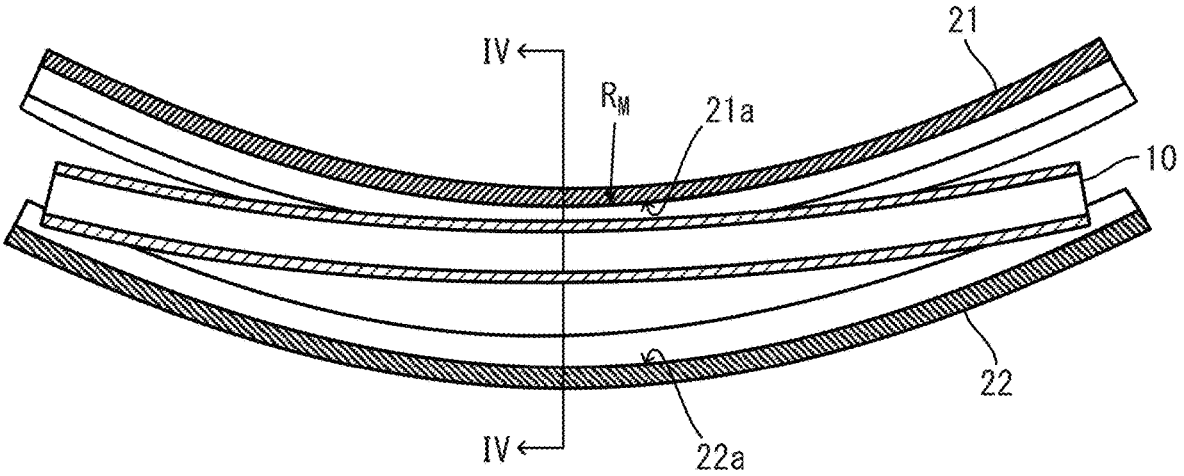
FIG. 3 schematically illustrates the shapes of the cross sections, along the longitudinal direction of the tube, of the original tube 10, a first die 21, and a second die 22, immediately after the original tube 10 is placed between the first die 21 and the second die 22.

As illustrated in FIGS. 3 and 4, the first die 21 has a first curved surface 21*a*.

As illustrated in FIGS. 3 and 4, the second die 22 has a second curved surface 22*a*.

As illustrated in FIGS. 5 and 6, in one time of the pressing, the first curved surface 21*a* and the second curved surface 22*a* are pressed against at least the portion of the original tube 10, so that bending and cross-sectioning are simultaneously performed on at least the portion of the original tube 10, and in the cross-sectioning, the circular cross-sectional shape of the original tube 10 is reduced in diameter.

The diameter reduction rate in one time of the pressing is more than 0% and less than 10%.

1. Original Tube (Starting Material Tube)

1.1 Longitudinal Shape of Original Tube

FIG. 1 illustrates a case in which an original tube 10 is a bent tube having a curved portion 10*a*. However, in the manufacturing method of the present disclosure, a straight tube without a curved portion may be used as the original tube 10. In the manufacturing method of the present disclosure, when the original tube 10 is a bent tube having a curved portion 10*a*, the curvature radius of the curved portion 10*a* may be reduced in bending, and in cross-sectioning, the cross-sectional shape of the curved portion 10*a* may be reduced in diameter. In the manufacturing method of the present disclosure, when the original tube 10 is a straight tube, a curved portion may be formed in at least a portion of the straight tube in bending, and in cross-sectioning, the cross-sectional shape of the curved portion may be reduced in diameter. The "straight tube" means a tube that does not meet the definition of the "bent tube" below. The "curved portion" means a portion that is curved in the longitudinal shape of the tube. The "bent tube" means a tube having a curved portion and having a shape in which the curvature radius R (minimum radius of inner bend) and the tube diameter D at the curved portion satisfy the relationship $R \leq 300D$.

When the original tube 10 is a bent tube, the bent tube may be curved in two dimensions or in three dimensions at the curved portion 10*a*. Although FIG. 1 illustrates a mode in which a bent tube is curved in the up-down direction of the paper at a curved portion 10*a*, the bent tube may further be curved in the direction out of the paper (depth direction)

at the curved portion. The bent shape at the curved portion is not particularly limited. For example, the bent tube may be arched at the curved portion. Note that it is preferable that the bent tube has substantially no discontinuous surface such as wrinkles or buckling at the curved portion.

When the original tube 10 is a bent tube, the curvature radius $R_A$ (minimum radius of inner bend) at the curved portion 10*a* is not particularly limited as long as the curvature radius $R_A$ is greater than the curvature radius RB that is described below. The curvature radius $R_A$ may be appropriately determined by taking into account the material, the wall thickness, and the aperture diameter (the circle equivalent diameter) of the bent tube, as well as, the curvature radius RB described later. Note that the bent shape (ridge) in the longitudinal direction at the curved portion may be configured by only one arc or may be configured by a plurality of arcs combined. The curvature may also vary continuously or discontinuously at the curved portion from one end in the longitudinal direction toward the other end.

When the original tube 10 is a bent tube, the number of curved portions 10*a* provided in the bent tube is not particularly limited. Although FIG. 1 illustrates a mode in which a bent tube has only one curved portion 10*a*, the bent tube may have a plurality of curved portions 10*a* with the same or different curvature radii $R_A$. When pressing, described later, is performed at each of the plurality of curved portions 10*a*, a plurality of times of pressing may be carried out simultaneously, or pressing may be carried out separately at different timing.

When the original tube 10 is a bent tube, the bent tube may have a straight tube portion other than the curved portion 10*a*. The "straight tube portion" refers to a straight section that is free of bends (a section that satisfies R>300D) in the longitudinal shape of the tube. Alternatively, the bent tube may be configured by only one or more curved portions 10*a*.

The original tube 10 need not be completely tubular in its entirety. For example, the original tube 10 may have a notch, a slit, a through-hole, intentional irregularities, and/or the like in a portion according to its application. These notches, slits, through-holes, irregularities, and/or the like provided in the original tube 10 may remain in the hollow shell part 100. On the other hand, the cross-sectional shape of a portion of the original tube 10 on which bending and cross-sectioning are performed may be uninterruptedly annular from the viewpoint of further increasing the shape accuracy during pressing.

The length of the original tube 10 is not particularly limited and may be appropriately determined according to its application. However, when the length of the original tube 10 is extremely short, it may be difficult to carry out bending. In the original tube 10, the length from one end in the longitudinal direction of the tube to the other end (the length of the line LA continuously connecting the centers of the aperture (the centers of the figures)) may be longer than the aperture diameter (the circle equivalent diameter) DA.

1.2 Cross-Sectional Shape of Original Tube

In the present application, the "cross-sectional shape" of a tube is a shape defined by the outer wall surface of the tube in the cross section orthogonal to the longitudinal direction of the tube (the cross section orthogonal to the tangent line of the line LA continuously connecting the opening centers (figure centers) of the tube). In other words, "the circular cross-sectional shape is reduced in diameter" means that the outer diameter of a circular tube is reduced. As illustrated in FIG. 2, the original tube 10 has a circular cross-sectional shape, at least in a portion on which bending and cross-sectioning are performed. For example, when the original tube 10 is a bent tube as illustrated in FIGS. 1 and 2 and the curvature radius of the curved portion 10*a* is reduced by pressing as illustrated in FIGS. 3 to 6, the cross-sectional shape of the original tube 10 at least in the curved portion 10*a* is circular. The cross-sectional shape of the original tube 10 in a portion on which bending and cross-sectioning are not performed is not particularly limited, and can be various shapes such as an elliptical shape, a flattened circular shape, a polygonal shape, a rounded polygonal shape, a combination of these shapes, and the like, in addition to a circular shape. The cross-sectional shape of the original tube 10 may be the same shape without substantially changing from one end in the longitudinal direction of the tube toward the other end, or may continuously or discontinuously change from one end in the longitudinal direction of the tube toward the other end.

In the manufacturing method of the present disclosure, the circular cross-sectional shape as described above, is reduced in diameter by cross-sectioning at least in a portion of the original tube 10. In other words, the diameter of the cross-sectional shape is reduced by cross-sectioning. In the present application, the "diameter" of the cross-sectional shape of an original tube is defined as "the length of a straight line connecting two points on the outer circumference (edge) of the cross-sectional shape of the original tube and passing through the figure center of said cross-sectional shape. The "circular" is defined as the ratio of the major diameter to the minor diameter (major diameter/minor diameter) of the cross-sectional shape being between 1.0 and 2.0 (preferably between 1.0 and 1.3). In other words, "circular" in the present application is not limited to a true circle where (major diameter/minor diameter) is 1.0, but also includes ellipses, and those with variations in diameter are also considered "circular." When the major diameter/minor diameter is within the range between 1.0 and 2.0, the manufacturing method of the present disclosure is expected to have a remarkable effect. The circularity (=4×π×area/(outer circumference length×outer circumference length)) in the cross-sectional shape of the original tube 10 may be, for example, between 0.8 and 1.0. The "circular" referred to in the present application may or may not have an outer circumference portion that is convex toward the center of the circularity (convex toward the inside of the cross-sectional shape), but the one without a convex is preferred.

The thickness (wall thickness) t of the original tube 10 is not particularly limited and may be appropriately determined according to its application. For example, the wall thickness t of the original tube 10 may be between 0.6 mm and 15.0 mm, or between 1.0 mm and 10.5 mm. The ratio t/D of the wall thickness t to the tube diameter D of the original tube 10 may be between 0.012 and 0.206. The wall thickness of the original tube 10 may be different for each portion.

1. 3 Material of Original Tube

The material of the original tube 10 may be appropriately determined according to its application as long as the material is capable of being pressed. For example, the original tube 10 may be made of metal, such as steel, iron, aluminum, titanium, and magnesium. The manufacturing method of the present disclosure can also be applied to a high-strength steel tube made of high-strength steel having a tensile strength of 290 MPa or more, 440 MPa or more, 590 MPa or more, or 780 MPa or more measured at room temperature in accordance with JIS Z 2241: 2011 and a high-strength steel tube made of ultra-high-strength steel having a tensile strength of 980 MPa or more.

1.4. Method of Obtaining Original Tube

The method of obtaining an original tube 10 is not particularly limited. When the original tube 10 is a straight tube, the straight tube may be manufactured by any known method. The original tube 10 may or may not have joints by welding or other means. When the original tube 10 is a bent tube having a curved portion 10*a*, the bent tube may be obtained, for example, by at least bending a straight tube or by at least bending a tube having a curved portion with a curvature radius larger than the curved portion 10*a*. In addition, a bent tube having a curved portion 10*a* may be obtained as the original tube 10 by at least bending and cross-sectioning a straight tube or a bent tube.

When the original tube 10 is a bent tube, the bending method for obtaining the bent tube is not particularly limited. For example, the bent tube may be obtained by pressing a straight tube from the outside of the tube. In other words, the bending to obtain a bent tube as the original tube 10 may be performed by applying pressure from the outside of the tube to the inside of the tube using a press die. In addition, when obtaining the bent tube as the original tube 10, cross-sectioning may be performed using a press die. In other words, the bending and cross-sectioning in obtaining the bent tube as the original tube 10 may be performed by applying pressure from the outside of the tube to the inside of the tube using a press die. The bent tube as the original tube 10 may be obtained by applying pressure to a straight tube or a bent tube from the outside of the tube toward the inside of the tube using a press die to simultaneously perform bending and cross-sectioning. This further improves the shape accuracy of the original tube 10. In either case, the press die for obtaining the bent tube as the original tube 10 and the press die for obtaining the hollow shell part 100 from the original tube 10 (the first die 21 and the second die 22), as described below, may be used separately. Thus, by replacing the dies, the same press machine can be used for pressing to obtain the bent tube as the original tube 10 and for pressing to obtain the hollow shell part 100 from the original tube 10. In other words, productivity and/or the like can be improved by sharing the same manufacturing equipment for the original tube 10 and the hollow shell part 100.

In the case of obtaining a bent tube as the original tube 10 through bending, the minimum curvature radius ($R_{A\text{-}min}$) at which no buckling or wrinkles occurs may be confirmed in advance by experiment or FEM analysis before actually bending. In other words, when bending, the occurrence of buckling and wrinkles in the bent tube as the original tube 10 can be further suppressed by bending in such a way that the curvature radius $R_A$ becomes the minimum curvature radius $R_{A\text{-}min}$ or more that has been confirmed in advance.

When the original tube 10 is a bent tube, the method of obtaining the bent tube is not limited to the pressing method from the outside of the tube using the press die described above. For example, the bent tube as the original tube 10 may be obtained by performing conventionally known bending, such as rotary draw bending (pipe bender), tube stretch bending, tube compression bending, intrusion bending, and tube roll bending. However, as described above, from the viewpoint of communizing the manufacturing equipment and improving productivity, it is preferable to obtain the bent tube as the original tube 10 by the pressing method from the outside of the tube using a press die.

2. First Die and Second Die

As illustrated in FIGS. 3 to 6, in the manufacturing method of the present disclosure, at least the first die 21 and the second die 22 are used as press dies. Note that other dies may be used in the manufacturing method of the present disclosure in addition to the first die 21 and the second die 22.

2.1 Longitudinal Shape of Dies

The longitudinal shape of each of the first die 21 and the second die 22 corresponds to the longitudinal shape of the hollow shell part 100 described below. As illustrated in FIGS. 3 to 6, the first die 21 has a first curved surface 21*a*. The first curved surface 21*a* may be a convex surface in the longitudinal shape. The second die 22 has a second curved surface 22*a*. The second curved surface 22*a* may be a concave surface in the longitudinal shape. The "convex surface" refers to a curved surface that is convex toward the original tube in the cross section along the longitudinal direction of the die and the original tube. The "concave surface" is a curved surface that is concave with respect to the original tube in the cross section along the longitudinal direction of the die and the original tube. In the manufacturing method of the present disclosure, these first curved surface 21*a* and second curved surface 22*a* are pressed against at least a portion of the original tube 10, and cross-sectioning and bending are simultaneously performed on at least the portion of the original tube 10. In other words, the first curved surface 21*a* and the second curved surface 22*a* each function as a pressing surface against the original tube 10. The curvature radius of the first curved surface 21*a* and the second curved surface 22*a* in the cross section along the longitudinal direction of the die and the original tube may be determined according to the curvature radius RB of the curved portion 100*a* of the hollow shell part 100 as described below. For example, the curvature radius $R_M$ (minimum radius of inner bend, refer to FIG. 3) of the first curved surface 21*a* of the first die 21 may be the same as or smaller than the curvature radius RB of the curved portion 100*a* of the hollow shell part 100.

The longitudinal shape of the portions of the first die 21 and the second die 22 other than the first curved surface 21*a* and the second curved surface 22*a* may be determined, for example, according to the longitudinal shape of the portion of the hollow shell part 100 other than the longitudinal shape of the curved portion 100*a*. The longitudinal shape of the portions other than the first curved surface 21*a* and the second curved surface 22*a* may be straight or curved.

2.2 Cross-Sectional Shape of Dies

The cross-sectional shapes of the first die 21 and the second die 22 may be such that the diameter of the circular cross-sectional shape of the original tube 10 can be reduced in the cross-sectioning. For example, in the manufacturing method of the present disclosure, in a portion on which the bending and cross-sectioning described above is performed, the die opening shape defined by the first die 21 and the second die 22 when the first die 21 and the second die 22 are brought together (when the first die 21 and the second die 22 are closed) may be smaller than the cross-sectional shape of the original tube 10 and similar to the cross-sectional shape of the original tube 10. In this way, when the die opening shape is smaller than the cross-sectional shape of the original tube 10 and the die opening shape is similar to the cross-sectional shape of the original tube 10, pressure can be applied more uniformly to the outer circumference of the original tube 10 when the cross-sectional shape of the original tube 10 is reduced by cross-sectioning.

The die opening shape defined by the first die 21 and the second die 22 when the first die 21 and the second die 22 are brought together may be determined appropriately according to the cross-sectional shapes of the original tube 10 and the hollow shell part 100. For example, as illustrated in FIG.

4, when the first die 21 is an upper die and the second die 22 is a lower die, the first die 21 may have a bottom (upper end) 21*x* facing the upper end 10*x* of the original tube 10 and a side wall 21*y* facing the side 10*y* of the original tube 10, and the second die 22 may have a bottom (lower end) 22*z* facing the lower end 10*z* of the original tube 10 and a side wall 22*y* facing the side 10*y* of the original tube 10. As illustrated in FIG. 6, when the first die 21 and second die 22 are closed, the die opening shape defined by the bottoms 21*x*, 22*z* and the side walls 21*y*, 22*y* may be circular, so that the entire circumference of the hollow shell part 100 is surrounded by the bottoms 21*x*, 22*z* and side walls 21*y*, 22*y*.

2.3 Other Matters Concerning Dies

The materials of the first die 21 and the second die 22 are not particularly limited, and can be made of materials commonly used for dies.

As described above, in the manufacturing method of the present disclosure, by moving the first die 21 and the second die 22 relatively closer together, the first curved surface 21*a* and the second curved surface 22*a* are pressed against the original tube 10 to apply pressure from the outer side to the inner side of the original tube 10. For example, when the first die 21 is an upper die and the second die 22 is a lower die, at least one of the first die 21 and the second die 22 may be moved in the up-down direction during the bending and cross-sectioning described below. In other words, the original tube 10 may be pressed vertically such that the first curved surface 21*a* is pressed from above and the second curved surface 22*a* is pressed from below against at least a portion of the original tube 10. In this case, the first die 21 and the second die 22 may be moved manually or mechanically and/or automatically by a drive unit or the like.

As described above, in the manufacturing method of the present disclosure, the first die 21 and the second die 22 have the first curved surface 21*a* and the second curved surface 22*a* as pressing surfaces, so that bending that corresponds to the first curved surface 21*a* and the second curved surface 22*a* can be performed on the original tube 10 simply by pressing the pressing surfaces against at least a portion of the original tube 10. For example, in the manufacturing method of the present disclosure, the first die 21 and the second die 22 may be linearly brought closer together so that the first curved surface 21*a* and the second curved surface 22*a* are pressed against the original tube 10. "The first die 21 and the second die 22 may be linearly brought closer together" means the locus drawn by a point of the moving die is linear when focused on a certain point of the moving die when at least one of the first die 21 and the second die 22 is moved to bring the first die 21 and the second die 22 relatively closer together. In other words, in the manufacturing method of the present disclosure, only at least one of the first die 21 and the second die 22 needs to be moved in one axial direction (one dimensionally) during the pressing. Thus, in the manufacturing method of the present disclosure, the pressing surfaces for cross-sectioning and bending are configured as curved surfaces, which enables bending of the original tube 10 without rotating or turning the dies or the original tube. In other words, the manufacturing method of the present disclosure does not require a complicated mechanism to rotate or turn the die or a complicated mechanism to rotate or turn the original tube in the cross-sectioning and bending, such as rotary draw bending.

3. Arrangement of Original Tube and Dies

In the manufacturing method of the present disclosure, the original tube 10 is first placed between the first die 21 and the second die 22. As illustrated in FIGS. 3 and 4, the first die 21 and the second die 22 may be arranged such that the first die 21 and the second die 22 face each other with the original tube 10 in between them. For example, when the first die 21 is an upper die and the second die 22 is a lower die, the first die 21 and the second die 22 may be arranged so as to sandwich the original tube 10 from above and below.

As illustrated in FIGS. 3 and 4, immediately after the original tube 10 is brought into contact with each of the first die 21 and the second die 22, at least two portions, one at one end and the other at the other end in the longitudinal direction of the original tube 10, may be in contact with the second die 22, and at least another portion other than the one and other end portions in the longitudinal direction of the original tube 10 (for example, the center portion in the longitudinal direction of the original tube 10) may be in contact with the first die 21. In this way, immediately after the original tube 10 is brought into contact with each of the first die 21 and the second die 22, at least three portions of the original tube 10 are in contact with and supported by the first die 21 and the second die 22, so that misalignment of the original tube 10 with the dies during pressing is easily suppressed.

Note that FIGS. 3 to 6 illustrate a mode in which pressing is performed such that the curved portion 100*a* of the hollow shell part 100 is convex downward, but pressing may be performed such that the curved portion 100*a* of the hollow shell part 100 is convex upward. However, workability of pressing is considered to be superior when the second die 22 is a lower die; the second curved surface 22*a* of the second die 22 is convex downward; and the curved portion 100*a* of the hollow shell part 100 is convex downward, since the original tube 10 can be easily placed and positioned on the second die 22. Furthermore, the pressing direction of the first die 21 and the second die 22 is not limited to the up-down direction as illustrated in FIGS. 3 to 6 and may be in a direction intersecting the up-down direction (for example, a horizontal direction). However, when considering workability, productivity, and the like, the pressing direction by the first die 21 and the second die 22 may be set as the up-down direction. A known press machine may be used as a press machine in which the first die 21 and the second die 22 are installed.

4. Cross-Sectioning

Figure 8:
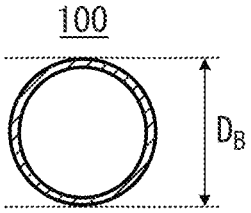
FIG. 8 schematically illustrates the shape of a cross section taken along the line VIII-VIII of FIG. 7.

In the manufacturing method of the present disclosure, pressing is performed one or more times on the original tube 10. In one time of pressing, the first curved surface 21*a* of the first die 21 and the second curved surface 22*a* of the second die 22 are pressed against at least a portion of the original tube 10 from the outside to cause material flow in the circumferential direction of the tube and reduce the cross-sectional shape of the original tube 10 in diameter. For example, as illustrated in FIGS. 2 and 8, the cross-sectioning reduces and changes the diameter (outer diameter) DA in the cross-sectional shape of the original tube 10 to the diameter (outer diameter) DB in the cross-sectional shape of the hollow shell part 100. In the manufacturing method of the present disclosure, it is important that the diameter reduction rate in one time of pressing is more than 0% and less than 10%. When the diameter reduction rate in one time of pressing is 10% or more, a bite defect easily occurs on the die and buckling easily occurs on the tube. The diameter reduction rate in one time of pressing may be 1% or more, 2% or more, 3% or more, 4% or more, or 5% or more, and may be 9% or less, 8% or less, 7% or less, or 6% or less. In particular, a hollow shell part 100 with more excellent surface properties is likely to be obtained when the diameter reduction rate in one time of pressing is more than 0% and 6% or less. Note that the diameter reduction rate is calculated by the following equation. As expressed in the equation below, the diameter reduction rate is calculated based on the diameter DA of the original tube 10 before cross-sectioning. For example, when 10 times of pressing is performed on the original tube 10 with diameter DA and the diameter reduction rate in each pressing is 2%, the total diameter reduction rate of the 10 times of pressing is 20%, and the diameter DB of the finally obtained hollow shell part 100 is 0.80 DA.

Diameter reduction rate (%)=[1−(cross-sectional diameter of hollow shell part after cross-sectioning/cross-sectional diameter of original tube before cross-sectioning)]×100

Note that, in the present application, "diameter reduction" refers to a decrease in an arbitrary diameter of a circular cross-sectional shape and a decrease in the length of the outer circumference of the circular cross-sectional shape. In other words, processing that involves "diameter enlargement" in at least a portion of the cross-sectional shape, as in the case of flattening a circular tube into an elliptical tube, does not fall under "reducing the diameter of a circular cross-sectional shape" in the present application. However, in the manufacturing method of the present disclosure, it is also possible to perform diameter enlargement processing on the original tube or hollow shell part before or after bending and cross-sectioning, if necessary.

In the manufacturing method of the present disclosure, pressure is applied from the outside of the original tube 10 toward the inside of the tube during cross-sectioning. In other words, in the manufacturing method of the present disclosure, pressure from the inside of the tube toward the outside of the tube such as by hydroforming is not applied, and the cross-sectional shape of the original tube 10 is transformed only by pressing from the outside of the tube. Note that a core die or the like may be installed inside of the tube, for example, at the tube ends or the like for cross-sectioning. This can further suppress dents, crushing, and/or the like at the tube ends and/or the like.

In the manufacturing method of the present disclosure, upon completion of cross-sectioning, a gap may or may not be created between the outer wall of the hollow shell part 100 and the inner walls of the first die 21 and the second die 22 in a cross section orthogonal to the longitudinal direction of the hollow shell part 100.

Note that, in the manufacturing method of the present disclosure, cross-sectioning on a portion other than the portion that undergoes bending to be the curved portion 100*a* is optional. For example, when obtaining a hollow shell part 100 having a straight tube portion, as well as, the curved portion 100*a*, cross-sectioning may or may not be performed on the straight tube portion. When cross-sectioning is performed on the straight tube portion, different cross-sectioning may be performed between the curved portion 100*a* and the straight tube portion. Furthermore, when the original tube 10 has a plurality of curved portions 10*a*, the same cross-sectioning or different cross-sectioning may be performed between one curved portion 10*a* and the other curved portion 10*a*.

5. Bending

In the manufacturing method of the present disclosure, as described above, pressing is performed one or more times on the original tube 10. By pressing, bending is performed on at least a portion of the original tube 10, together with the cross-sectioning described above. In other words, the first curved surface 21*a* of the first die 21 and the second curved surface 22*a* of the second die 22 are pressed against the original tube 10 from the outside of the original tube 10 to cause a material flow in the longitudinal direction of the tube in at least a portion of the original tube 10 to form a curved portion 100*a* with a smaller curvature radius. For example, as illustrated in FIGS. 1 to 8, the bending transforms the curved portion 10*a* with a curvature radius $R_A$ into a curved portion 100*a* with a curvature radius RB.

Pressure is applied from the outside of the tube toward the inside of the tube during bending. In other words, in the manufacturing method of the present disclosure, pressure from the inside of the tube toward the outside of the tube such as by hydroforming is not applied, and the curved portion 100*a* is formed in the original tube 10 only by pressing from the outside of the tube.

In the manufacturing method of the present disclosure, upon completion of bending, a gap may or may not be created between the outer wall of the hollow shell part 100 and the press die in a longitudinal direction of the hollow shell part 100.

Note that, in the manufacturing method of the present disclosure, bending on a portion other than a portion in which the curved portion 100*a* is formed is optional. For example, a hollow shell part 100 having a curved portion 100*a* and a curved portion and/or a straight tube portion other than the curved portion 100*a* may be manufactured by applying the bending to only a portion of the original tube 10.

In the manufacturing method of the present disclosure, the above-described cross-sectioning and bending are performed simultaneously. In other words, during pressing, the material flow in the circumferential direction of the tube and the material flow in the longitudinal direction of the tube simultaneously proceed at least at a portion of the original tube 10, thereby ensuring high shape accuracy in the hollow shell part 100 after pressing. In particular, it is considered that the reduction of the cross-sectional shape of the original tube 10 in the cross-sectioning simultaneously with the bending facilitates a material flow in the circumferential and longitudinal directions of the tube, thereby suppressing wrinkles and buckling caused by the bending. Note that in the manufacturing method of the present disclosure, as long as the cross-sectioning and bending may proceed simultaneously at a certain point in time, the timing of the start and completion of the cross-sectioning and the timing of the start and completion of the bending need not be strictly simultaneous. For example, in one time of pressing, when the period from the time when the first die 21 and the second die 22 contact the original tube 10 until the time when the pressing is completed is halved into a first half and a second half, cross-sectioning and bending may be performed simultaneously on at least a portion of the original tube 10 at least at one point in the second half.

When obtaining the hollow shell part 100 by performing the above-described pressing on the original tube 10, the minimum curvature radius RB-min where buckling and wrinkles do not occur may be confirmed by experiment, FEM analysis, or the like before actually pressing the original tube 10. In other words, when pressing the original tube 10, the occurrence of buckling and wrinkles in the hollow shell part 100 can be further suppressed by bending the original tube 10 such that the curvature radius RB becomes the minimum curvature radius RB-min or more that has been confirmed in advance.

In the manufacturing method of the present disclosure, the above-described pressing is performed one or more times on the original tube 10. The number of times of pressing may be two or more, three or more, four or more, or five or more. When two or more times of pressing is performed, the diameter reduction rate in each pressing may be more than 0% and less than 10%. The diameter reduction rate in each pressing may be 1% or more, 2% or more, 3% or more, 4% or more, or 5% or more, as well as, 9% or less, 8% or less, 7% or less, or 6% or less. In particular, a hollow shell part 100 with more excellent surface properties can be easily obtained when the diameter reduction rate in each pressing is more than 0% and 6% or less. For example, in the manufacturing method of the present disclosure, after a first pressing that entails diameter reduction of more than 0% and less than 10%, a second pressing that entails diameter reduction of more than 0% and less than 10% may be performed. The diameter reduction rate in each pressing may be the same or different. For example, the diameter reduction rate in the first pressing may be greater than, less than, or the same as the diameter reduction rate in the second pressing. In this way, the curvature radius RB at the curved portion 100*a* of the hollow shell part 100 can easily be further reduced when the above-described pressing is performed two or more separate times on the original tube 10.

6. Hollow Shell Part 6. 1 Longitudinal Shape of the Hollow Shell Part

Figure 7:
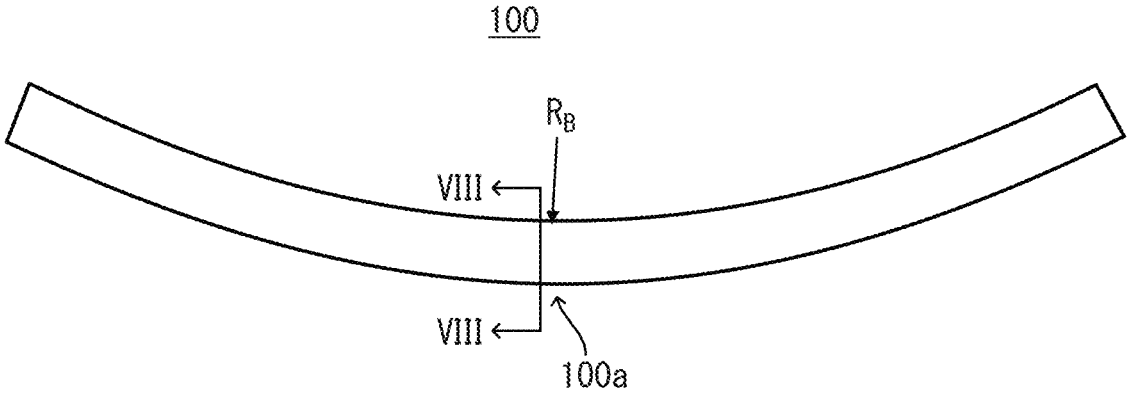
FIG. 7 is a schematic diagram to describe an example of the longitudinal shape of a hollow shell part 100.

As illustrated in FIG. 7, the hollow shell part 100 has a curved portion 100*a* at least partially. The longitudinal direction of the hollow shell part 100 may correspond to the longitudinal direction of the original tube 10 before pressing. The hollow shell part 100 may be curved in two dimensions or three dimensions at the curved portion 100*a*. For example, in FIG. 7, the hollow shell part 100 is illustrated to be curved in the up-down direction of the paper at the curved portion 100*a* but may be further curved directed out of the paper at the curved portion 100*a*. The bent shape at the curved portion 100*a* is not particularly limited. For example, the hollow shell part 100 may be arched at the curved portion 100*a*. The bent shape of the hollow shell part 100 can be easily changed by changing the shapes of the first curved surface 21*a* of the first die 21 and the second curved surface 22*a* of the second die 22 described above.

The curvature radius RB (minimum radius of inner bend) at the curved portion 100*a* is not particularly limited. The curvature radius RB may be smaller than the above-described curvature radius $R_A$ when the original tube 10 is a bent tube having a curved portion 10*a*. Note that the bent shape (ridge) in the longitudinal direction of the curved portion 100*a* may be configured by only one arc or may be configured by a plurality of arcs combined. The curvature may also vary continuously or discontinuously at the curved portion 100*a* from one end in the longitudinal direction toward the other end.

Although FIG. 7 illustrates a mode in which the hollow shell part 100 has only one curved portion 100*a*, the hollow shell part 100 may have a plurality of curved portions 100*a* with the same or different curvature radii RB.

The hollow shell part 100 may have a straight tube portion other than the curved portion 100*a*. Alternatively, the hollow shell part 100 may be configured by only one curved portion 100*a* or a plurality of curved portions 100*a*.

The hollow shell part 100 need not be fully tubular in its entirety. For example, the hollow shell part 100 may have a notch or a slit in a portion. The hollow shell part 100 may also have a through-hole or intentional irregularities in a portion.

The length of the hollow shell part 100 is not particularly limited and may be appropriately determined according to its application. The length of the hollow shell part 100 may be the same as or different from the length of the original tube 10. In the manufacturing method of the present disclosure, the length of the hollow shell part 100 may be longer than the length of the original tube 10 because the cross-sectional shape is reduced in diameter by cross-sectioning.

6.2 Cross-Sectional Shape of the Hollow Shell Part

As illustrated in FIG. 8, the cross-sectional shape of the hollow shell part 100 at the curved portion 100*a* is circular. The cross-sectional shape of the hollow shell part 100 at a portion other than the curved portion 100*a* is not particularly limited, and may take various shapes, such as an elliptical shape, a flattened circular shape, a polygonal shape, a rounded polygonal shape, as well as a circular shape, and a combination of these shapes. The cross-sectional shape of the hollow shell part 100 may be appropriately determined according to its application. The cross-sectional shape of the hollow shell part 100 can be easily changed by changing the cross-sectional shapes of the first die 21 and the second die 22.

The cross-sectional shape of the hollow shell part 100 may be the same shape without changing from one end in the longitudinal direction of the tube toward the other end or may continuously or discontinuously change from one end in the longitudinal direction of the tube toward the other end. When the hollow shell part 100 has a straight tube portion, as well as, the curved portion 100*a*, the curved portion 100*a* and the straight tube portion may have the same cross-sectional shapes as each other or may have different cross-sectional shapes. Further, when the hollow shell part 100 has a plurality of curved portions 100*a*, the curved portions 100*a* may have the same cross-sectional shapes as each other or may have different cross-sectional shapes.

The thickness (wall thickness) of the hollow shell part 100 is not particularly limited and may be appropriately determined according to its application. The thickness of the hollow shell part 100 may vary from portion to portion. Note that when bending is performed on the original tube 10 by rotary draw bending or the like as in the conventional technique, the wall thickness $T_1$ inside the bend becomes thicker, while the wall thickness $T_2$ outside the bend tends to become excessively thin. In contrast, in the hollow shell part 100 obtained by the manufacturing method of the present disclosure, the wall thickness $T_1$ inside of the bend and the wall thickness $T_2$ outside of the bend at the curved portion 100*a* tend to be thicker compared to the case of conventional rotary draw bending or the like, and, as a result, the thickness reduction outside of the bend tends to be suppressed. This is due to the fact that, as described above, cross-sectioning is performed simultaneously with bending, causing the tube material to flow in the circumferential direction.

As described above, in the manufacturing method of the hollow shell part 100 of the present disclosure, the original tube 10 is pressed so as to simultaneously perform cross-sectioning and bending on at least a portion of the original tube 10. This makes it possible to suppress unsatisfactory forming (wrinkles and buckling) at the curved portion 100*a* of a hollow shell part 100. Note that the manufacturing method of the present disclosure can also be applied, for example, to a case of manufacturing a tapered tube. In other words, a tapered tube may be obtained as the hollow shell part 100 by cross-sectioning according to the manufacturing method of the present disclosure, or a tapered tube may be used as the original tube 10 for obtaining the hollow shell part 100.

6.3 Examples of the Application of the Hollow Shell Part

The application of the hollow shell part 100 obtained by the manufacturing method of the present disclosure is diverse. For example, the application may be in automobile parts, such as a bumper beam, a suspension member, a side rail, a trailing arm, an upper arm, a pillar, a torsion beam, a door impact beam, and an instrument panel beam.

EXAMPLES

Hereinafter, the effects of the manufacturing method of the hollow shell part of the present disclosure are described in more detail with Examples, provided, however, the method of the present disclosure is not limited to the following Examples.

1. Examination of Pressing Method

1.1 Comparative Example 1

Figure 9:
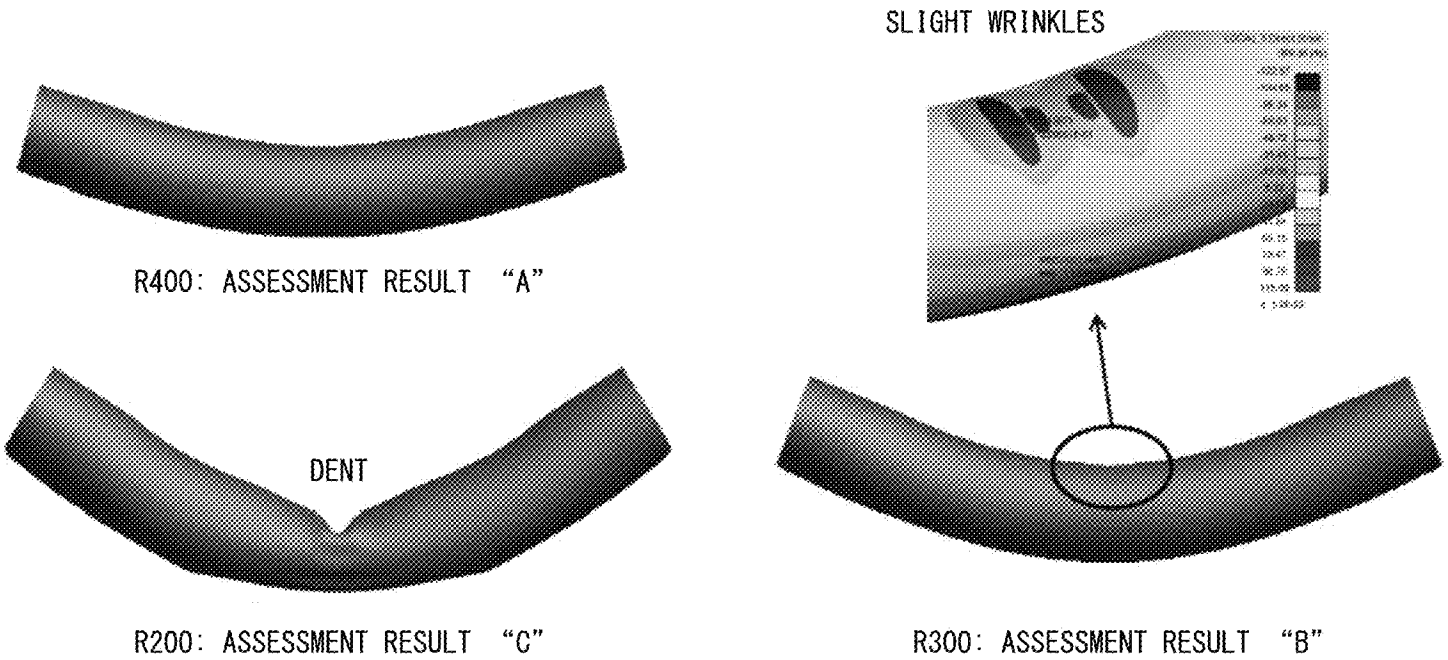
FIG. 9 illustrates a FEM analysis result for Comparative Example 1.

The present inventors examined how far a straight tube as an original tube (a circular tube made of 440 MPa-class steel, φ60.5 mm, thickness 2.3 mm, total length 380 mm) could be bent without wrinkling or buckling in a single process using a press die. The cross-sectional shape before and after the bending was assumed to be virtually unchanged. FEM analysis was used in the examination. The results are illustrated in FIG. 9. As illustrated in FIG. 9, when forming a curved portion with a curvature radius of 400 mm (R400), bending was possible without wrinkling or buckling, but wrinkling occurred in a curved portion with R300, and buckling and a large dent occurred in a curved portion with R200.

1.2 Comparative Example 2

Figure 10:
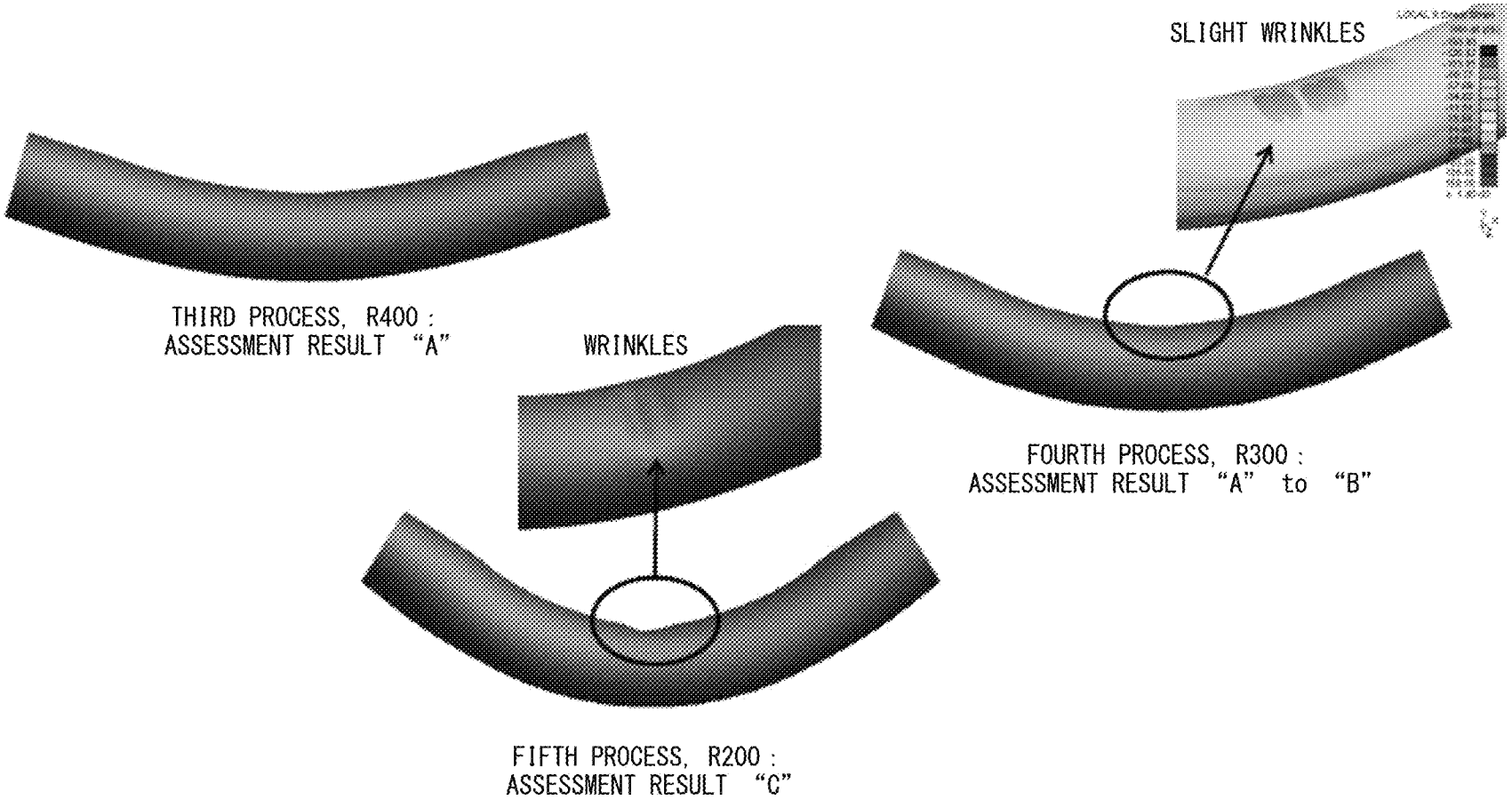
FIG. 10 illustrates a FEM analysis result for Comparative Example 2.

The present inventors examined how far a straight tube as an original tube that underwent multiple press bending in increments of R100 starting from R600 could be bent without wrinkling or buckling. The cross-sectional shape before and after the bending was virtually unchanged. As a result, as illustrated in FIG. 10, bending was possible up to R400 without wrinkling or buckling, but wrinkles occurred at a curved portion with R300 and large wrinkles occurred at a curved portion with R200. Comparative Example 2 was able to suppress unsatisfactory forming compared to Comparative Example 1, but even so, wrinkles and buckling could be suppressed only up to R400.

1.3 Comparative Example 3

Figure 11:
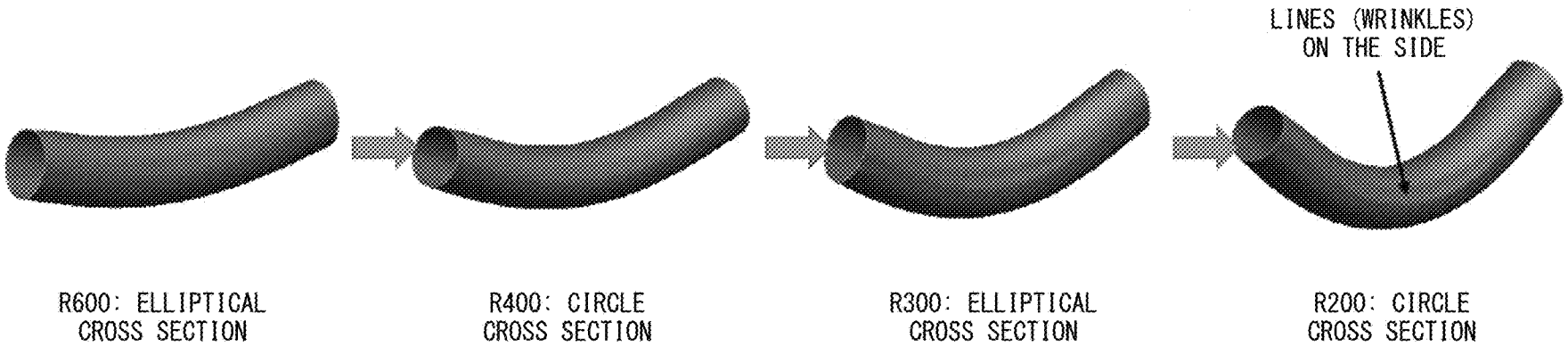
FIG. 11 illustrates a FEM analysis result for Comparative Example 3.

The present inventors examined how far a straight tube as an original tube could be bent without wrinkling or buckling by simultaneously applying cross-sectioning and bending using a press die. Specifically, as illustrated in FIG. 11, "bending and cross-sectioning simultaneously to transform the cross-sectional shape from a true circle to an ellipse" and "bending and cross-sectioning simultaneously to transform the cross-sectional shape from an ellipse to a true circle" were alternately performed on the straight tube from R600 to R400, from R400 to R300, and from R300 to R200. The major diameter of the ellipse was set to coincide with the vertical direction and the minor diameter with the horizontal direction. In addition, the length of the outer circumference of the cross-sectional shape was virtually unchanged before and after the cross-sectioning. As a result, although it was possible to form a curved portion with R200 without causing wrinkles or buckling on the inside of the bend, lines and wrinkles originating from the die boundary appeared on the side of the bend with R300.

1.4 Example 1

Figure 12:
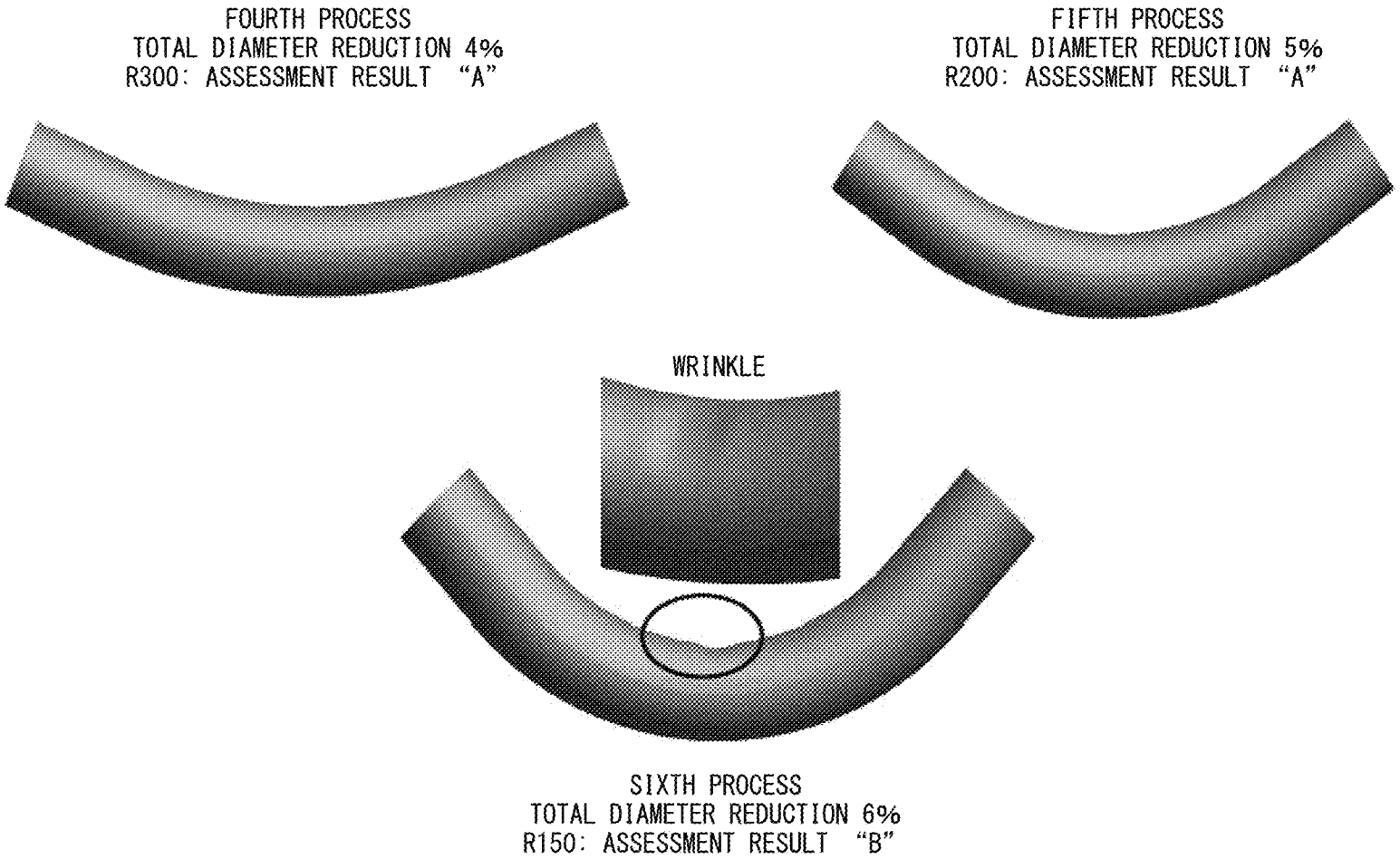
FIG. 12 illustrates a FEM analysis result for Example 1.

The present inventors examined how far a straight tube as an original tube that underwent multiple press bending in increments of R100 starting from R600 could be bent without wrinkling or buckling. Simultaneously as each bending, cross-sectioning was performed to reduce the diameter of the cross-sectional shape of the tube by 1%. As a result, as illustrated in FIG. 12, bending was possible up to R200 without wrinkling or buckling. Subsequently, when bending was performed from R200 to R150 along with cross-sectioning at a diameter reduction rate of 1%, wrinkles occurred at a curved portion with R150.

1.5 Example 2

Figure 13:
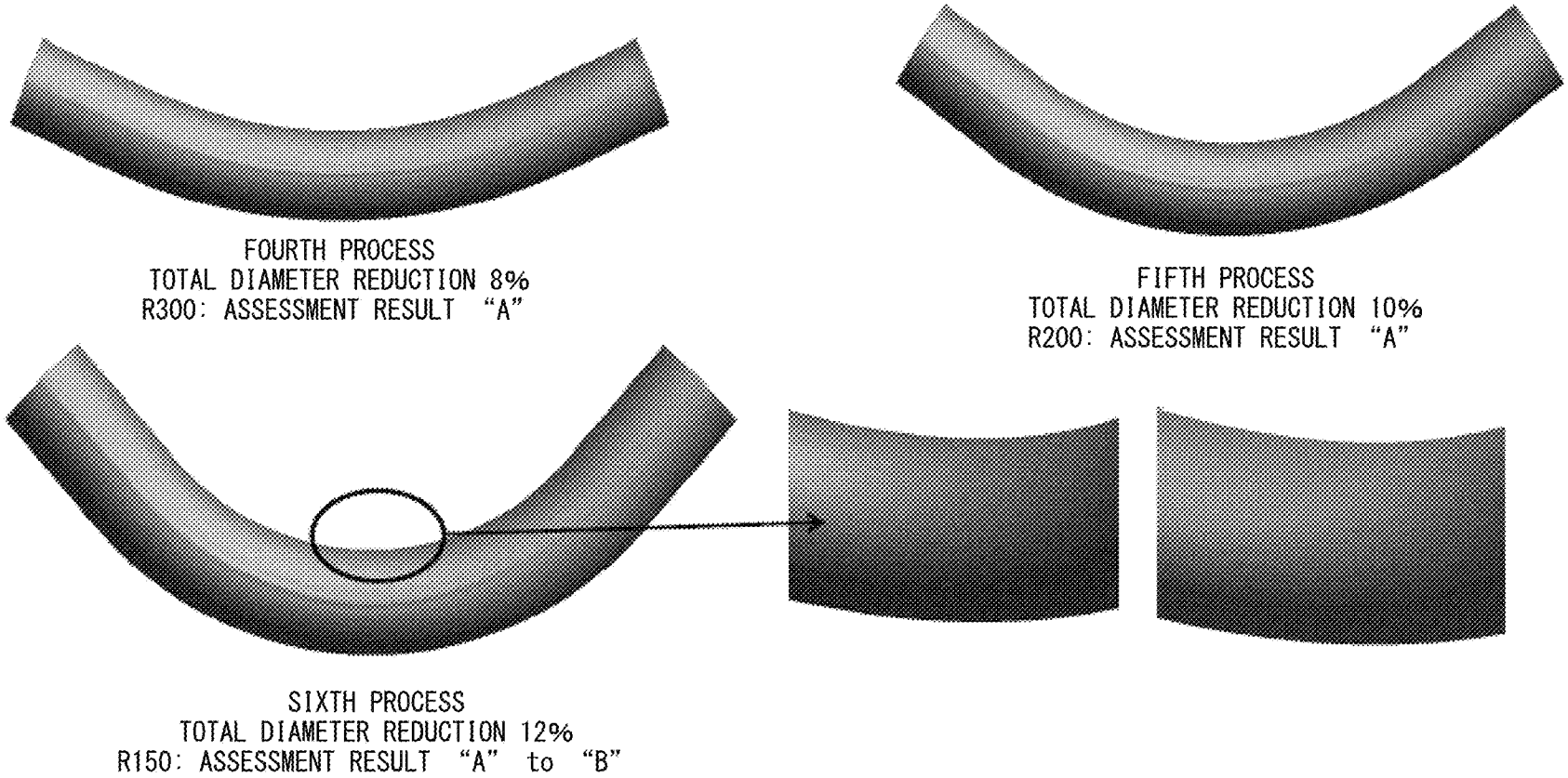
FIG. 13 illustrates a FEM analysis result for Example 2.

The present inventors examined how far a straight tube as an original tube that underwent multiple press bending in increments of R100 starting from R600 could be bent without wrinkling or buckling. Simultaneously as each bending, cross-sectioning was performed to reduce the diameter of the cross-sectional shape of the tube by 2%. As a result, as illustrated in FIG. 13, bending was possible up to R200 without wrinkling or buckling. Subsequently, when bending was performed from R200 to R150 along with cross-sectioning at a diameter reduction rate of 2%, slight wrinkles occurred at a curved portion with R150. Compared to Example 1, the degree of wrinkling could be reduced and bending limit improved in Example 2.

1.6 Example 3

Multiple press bending was performed on a straight tube as an original tube in increments of R100 starting from R600 till R400 as in a similar way to Comparative Example 2 without changing the cross-sectional shape of the tube, and then, press bending was further performed along with cross-sectioning to reduce the diameter of the cross-sectional shape of the tube by 6% from R400 to R200 in increments of R100. As a result, wrinkles at a curved portion with R300 and a curved portion with R200 were significantly reduced compared to Comparative Example 2. However, when press bending was subsequently performed along with cross-sectioning to reduce the diameter of the cross-sectional shape of the tube by 6% from R200 to R150, large wrinkles and buckling occurred.

1.7 Comparative Example 4

Press bending was performed on a straight tube as an original tube from R600 to R500. Simultaneously as the bending, cross-sectioning was performed to reduce the diameter of the cross-sectional shape of the tube by 12%. In this case, the diameter reduction rate was excessively large, resulting in large wrinkles and buckling of the tube, making proper bending difficult.

Table 1 below summarizes the results of Comparative Examples 1 to 4 and Examples 1 to 3. In Table 1 below, "A," "B," and "C" each mean the following. In addition, "A to B" means that it is about the middle of A and B, and "B to C" means that it is about the middle of B and C.

A: No wrinkling or buckling at a curved portion.

B: Wrinkles occur at a curved portion, but not to the extent to cause buckling.

C: Large wrinkles and buckling occur at a curved portion.

TABLE 1

| | Diameter reduction rate | Number of times of pressing | Cross-sectional shape of original tube | Cross-sectional shape of hollow shell part | Properties of the curved portion of hollow shell part (presence of wrinkles and buckling) | | | | | |
|---|---|---|---|---|---|---|---|---|---|---|
| | | | | | Curvature radius R600 | Curvature radius R500 | Curvature radius R400 | Curvature radius R300 | Curvature radius R200 | Curvature radius R150 |
| Comparative Example 1 | 0% | 1 | True circle | True circle | — | — | A | B | C | — |
| Comparative Example 1 | 0% | plurality of times | True circle | True circle | A | A | A | A-B | B-C | — |
| Comparative Example 3 | 0% | plurality of times | True circle | Ellipse → True circle (alternatively) | A | — | A | A-B | A-B | — |
| Comparative Example 3 | 12% | 1 | True circle | True circle | C | — | — | — | — | — |
| Example 1 | 1% each | plurality of times | True circle | True circle | A | A | A | A | A | B |
| Example 2 | 2% each | plurality of times | True circle | True circle | A | A | A | A | A | A-B |
| Example 1 | 6% each from R400 | plurality of times | True circle | True circle | A | A | A | A | B | C |

As described above, from the results of Comparative Examples 1 to 3 and Examples 1 to 3, it was found that when bending is performed on an original tube by pressing, a curved portion with a small curvature radius can be formed on the original tube without wrinkles or buckling by performing cross-sectioning to reduce the diameter of the cross-sectional shape of the tube simultaneously as the bending. From the results of Comparative Example 4, it was also found that wrinkles and buckling occur when the diameter reduction rate in one time of pressing is 10% or more.

2. Examination of the Number of Diameter Reduction Processes

In the diameter reduction bending by pressing as in Examples 1 and 2, the present inventors examined process patterns that can suppress buckling and wrinkling up to R200 while keeping the number of processes and the amount of diameter reduction as small as possible. As a result of various examinations, it was found that buckling and wrinkling can be suppressed up to R200, for example, in the following processes.

Pattern 1: Bend to R600 (with a diameter reduction rate of 1%), then bend to R300 (with a diameter reduction rate of 1%), and finally bend to R200 (with a diameter reduction rate of 0%).

Pattern 2: Bend to R400 (with a diameter reduction rate of 1%), then bend to R300 (with a diameter reduction rate of 1%), and finally bend to R200 (with a diameter reduction rate of 0%).

3. Analysis of Wall Thickness Distribution

For the above-described Examples 1 and 2, the present inventors checked the wall thickness distribution just before closing the press dies (before the bottom dead center) and the wall thickness distribution at the bottom dead center. As a result, it was found that the overall wall thickness of the tube increased and the wall thinning on the outside of the bend was mitigated. It is considered that the reduction of the diameter of the cross-sectional shape imparted a high circumferential compressive stress to the tube during clamping at the bottom dead center, allowing the tube material to flow appropriately in the circumferential direction. In other words, when the period from the time when the dies contact the original tube until when the pressing is completed is halved into a first half and a second half, cross-sectioning and bending are simultaneously performed on at least a portion of the original tube at least at one point in the second half.

4. Summary

As described above, the following method has been found to be able to easily form a curved portion with a small curvature radius in an original tube while suppressing wrinkles and buckling.

The manufacturing method for a hollow shell part includes:

placing an original tube between a first die and a second die; and moving the first die and the second die relatively closer together and pressing one or more times on the original tube by pressing the first die and the second die against the original tube, wherein the original tube has a circular cross-sectional shape in at least a portion thereof, the first die has a first curved surface, the second die has a second curved surface, in one time of the pressing, the first curved surface and the second curved surface are pressed against at least the portion of the original tube so that cross-sectioning and bending are simultaneously performed on at least the portion of the original tube, in the cross-sectioning, the circular cross-sectional shape of the original tube is reduced in diameter, and a diameter reduction rate in one time of the pressing is more than 0% and less than 10%.

REFERENCES SIGNS LIST

10 Original tube (Starting material tube)

10*a* Curved portion

10*x* Upper end

10*y* Side

10*z* Lower end
21 First die
21*x* Bottom
21*y* Side wall
22 Second die
22*z* Bottom
22*y* Side wall
100 Hollow shell part
100*a* Curved portion

The invention claimed is:

1. A manufacturing method for a hollow shell part, the method comprising:

placing an original tube between a first die and a second die; and moving the first die and the second die relatively closer together and pressing one or more times on the original tube by pressing the first die and the second die against the original tube, wherein the original tube has a circular cross-sectional shape in at least a portion thereof, the first die has a first curved surface, the second die has a second curved surface, in one time of the pressing, the first curved surface and the second curved surface are pressed against at least the portion of the original tube so that cross-sectioning and bending are simultaneously performed on at least the portion of the original tube, in the cross-sectioning, the circular cross-sectional shape of the original tube is reduced in diameter, and a diameter reduction rate in one time of the pressing is more than 0% and less than 10%.

2. The manufacturing method according to claim 1, wherein two or more times of the pressing is performed, and the diameter reduction rate in each of the pressing is greater than 0% and less than 10%.

3. The manufacturing method according to claim 1, wherein the first die and the second die are linearly brought closer together, so that the first curved surface and the second curved surface are pressed against the original tube.

4. The manufacturing method according to claim 1, wherein in a portion on which the cross-sectioning and the bending are performed, a die opening shape defined by the first die and the second die when the first die and the second die are brought together is smaller than the cross-sectional shape of the original tube and similar to the cross-sectional shape of the original tube.

5. The manufacturing method according to claim 1, wherein the diameter reduction rate in one time of the pressing is more than 0% and 6% or less.

6. The manufacturing method according to claim 1, wherein the original tube is a bent tube having a curved portion, in the bending, a curvature radius of the curved portion is reduced, and in the cross-sectioning, the cross-sectional shape of the curved portion is reduced in diameter.

7. The manufacturing method according to claim 1, wherein the original tube is a straight tube, in the bending, a curved portion is formed in at least a portion of the straight tube, and in the cross-sectioning, the cross-sectional shape of the curved portion is reduced in diameter.

8. The manufacturing method according to claim 1, wherein the first die is an upper die, the second die is a lower die, and in the cross-sectioning and the bending, at least one of the first die and the second die moves in an up-down direction.

9. The manufacturing method according to claim 1, wherein when a period from time when the first die and the second die contact the original tube until when the pressing is completed is halved into a first half and a second half in one time of the pressing, the cross-sectioning and the bending are simultaneously performed on at least a portion of the original tube at least at one point in the second half.

* * * * *